United States Patent [19]

Rossman

[11] 3,932,972

[45] Jan. 20, 1976

[54] STAIR CONSTRUCTION

[76] Inventor: Rudolph J. Rossman, Box 16-B, Star Rte., Hillman, Mich. 49746

[22] Filed: Oct. 29, 1974

[21] Appl. No.: 518,709

[52] U.S. Cl. ..... 52/183; 52/9; 52/177; 52/188

[51] Int. Cl.[2] ..... E04F 11/00

[58] Field of Search ..... 52/177, 179, 182, 183, 52/188, 191; 16/5, 8, 10, 11, 12, 13, 14, 15; 24/252 CD, 252 DC, 252 R, 252 T, 253

[56] References Cited

UNITED STATES PATENTS

| | | | |
|---|---|---|---|
| 1,177,402 | 3/1916 | Engemann | 52/179 |
| 1,257,221 | 2/1918 | Grossman | 52/188 |
| 1,676,317 | 7/1928 | Bennett | 52/188 |
| 2,867,855 | 1/1959 | Xanten | 52/182 |
| 2,950,513 | 8/1960 | Cochran | 52/177 |
| 3,305,428 | 2/1967 | Moore et al. | 16/5 |
| 3,713,511 | 1/1973 | Hinkle | 52/182 |

FOREIGN PATENTS OR APPLICATIONS

| | | | |
|---|---|---|---|
| 553,808 | 6/1943 | United Kingdom | 52/177 |

*Primary Examiner*—Frank L. Abbott
*Assistant Examiner*—William Randolph
*Attorney, Agent, or Firm*—Learman & McCulloch

[57] ABSTRACT

A stair construction in which a stair tread member is releasably clamped in position upon a pair of spaced tread support frame members in a manner such that a tubular sleeve of carpeting or other flexible tread covering material is simultaneously snugly, yet releasably, fitted in place on the tread member. The construction includes a pair of individual side frame assemblies in a parallelogram linkage form wherein the inclination of the prefabricated side frame assemblies can be adjusted as required in the field while maintaining the tread support frame members in a true horizontal position.

9 Claims, 7 Drawing Figures

STAIR CONSTRUCTION

SUMMARY OF THE INVENTION

The primary objective of the present invention is to provide a stair construction employing a prefabricated frame which can be easily adjusted in the field to various stair inclinations, which can be installed and assembled with a minimum amount of time, skill and effort, and in which carpeting or other flexible tread covering material can be readily replaced or shifted when worn.

The construction includes a pair of side frame assemblies constructed in a parallelgram linkage form with two parallel elongated main link members of each frame assembly pivotally connected to parallel tread support members. The parallelogram linkage arrangement enables the inclination of the elongate main frame members to be adjusted to the desired inclination of the stair, as is frequently required because of constructional tolerances. The frame assemblies are installed on opposite sides of the stair well and detachable tread members are supported upon and extend between the tread support frame members on the opposed frame assemblies.

The tread members take the form of a plate-like member having downwardly and inwardly turned flanges along its longitudinal edges which define inwardly facing opposed longitudinal recesses on the underside of the tread member. A fixed tongue member extending between the tread support frame members is located to be seated within the tread member recess along the front edge of the tread, while a clamp member pivotally mounted upon and extending between the tread support frame members is receivable within the rearward recess in the tread member to detachably clamp the tread member in place.

A sleeve of carpeting or other flexible covering material may be slipped onto the tread member prior to its installation, the tongue member and clamp member engaging the outer side of the sleeve to press and tuck the sleeve into the tread member recesses as the tread member is clamped in position to snugly conform the sleeve to the tread member surface. When the covering material becomes worn, the tread member may be detached from the frame and the sleeve of covering material slipped around the tread member to a new position exposing an unworn portion of the sleeve or the sleeve may be entirely replaced.

Other objects and features of the invention will become apparent by reference to the following specification and to the drawings.

IN THE DRAWINGS

Figure 1:
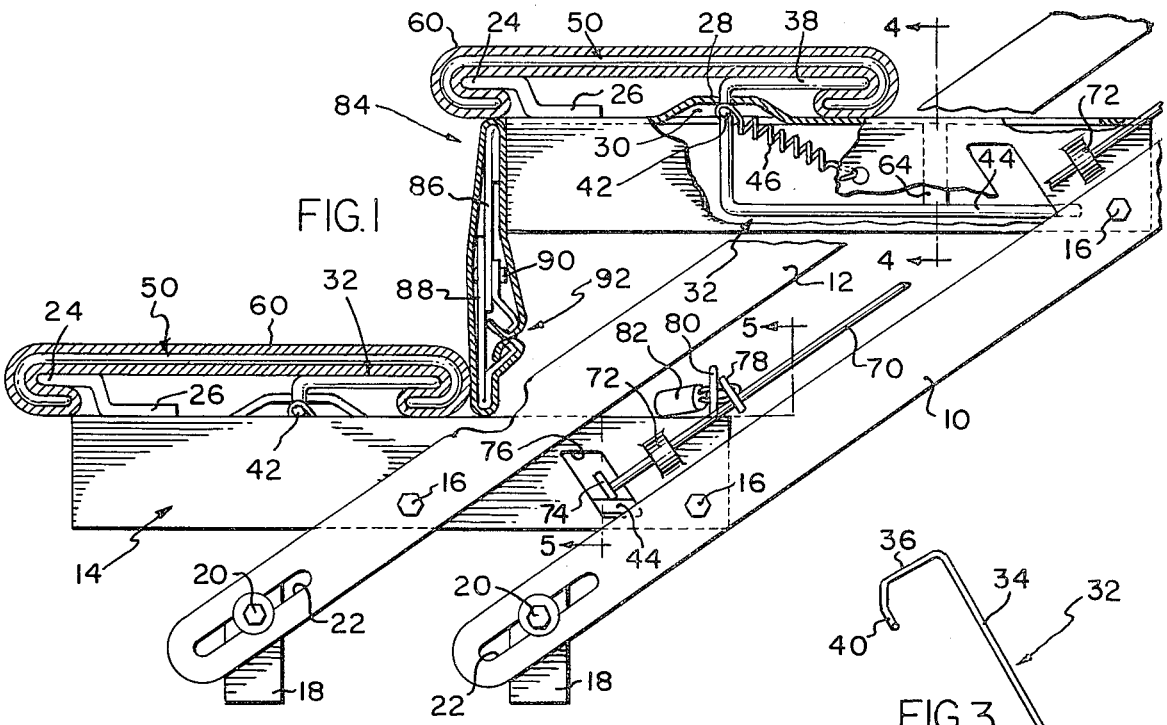
FIG. 1 is a side elevational view, with certain parts broken away or shown in section, of a stair construction embodying the present invention.
Figure 2:
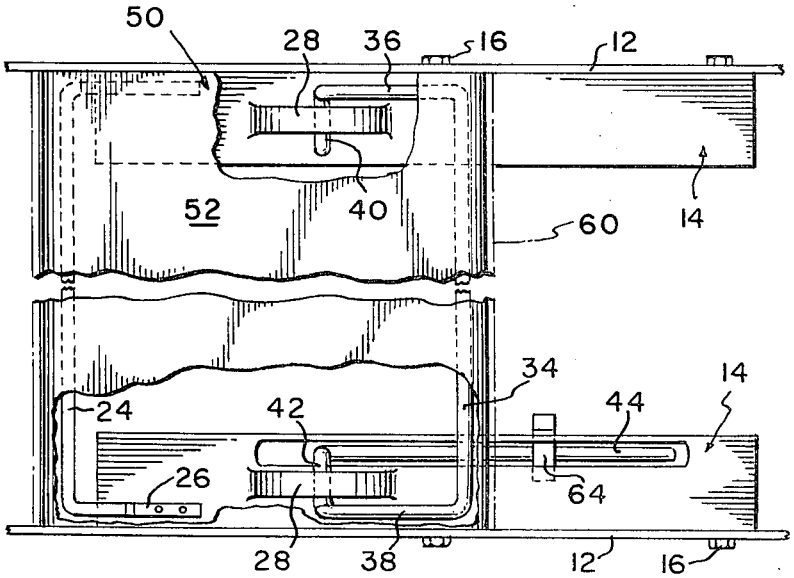
FIG. 2 is a top plan view, with certain parts broken away or shown in section, of a tread assembly of FIG. 1.

Referring now particularly to FIGS. 1 and 2, a stair construction embodying the present invention is made up of a pair of right and left handed side frame assemblies, each of which includes a pair of elongate main frame members 10 and 12 and a plurality of spaced parallel tread support frame members designated generally 14 which are pivotally coupled as by bolt assemblies designated generally 16 to the inner sides of main frame members 10 and 12 so that the assembled main frame and tread support frame members constitute a parallelogram linkage assembly. Main frame members 10 and 12 extend the entire length of the stair construction. For purposes of illustration only a lower portion with two tread frame support members has been shown in FIG. 1, however, it is believed apparent that the length of main frame members 10 and 12 and the number of tread support frame members 14 will vary in accordance with the dimensions of the particular installation.

At the lower ends of each of main frame members 10 and 12, a bracket 18 is coupled to the frame member for longitudinal adjustment by means of a nut and bolt connection 20 passing through an elongate slot 22 in the frame member. This connection enables the angle of inclination of main frame members 10 and 12 to be adjusted as required with a corresponding adjustment of the two main frame members relative to each other to position tread support frame members 14 in a horizontal position after the angle of inclination of the main frame members has been established.

Figure 4:
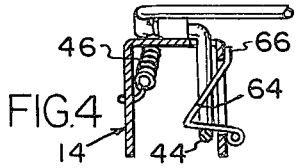
FIG. 4 is a detail cross sectional view taken on the line 4—4 of FIG. 1.
Figure 5:
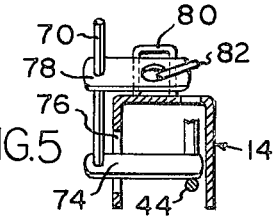
FIG. 5 is a detail cross sectional view taken approximately on the line 5—5 of FIG. 1.

As best seen in FIGS. 4 and 5, tread support frame members 14 are of inverted U-shaped transverse cross section. Mounted upon and extending between the forward ends of each opposed pair of tread support members 14 is a tongue member 24 formed of a metal rod stock. Tongue member 24 is spaced above the upper surface of frame members 14 by a downwardly offset mounting section 26 which rests upon the frame member 14 to support the main portion of the tongue member above frame member 14.

Figure 7:
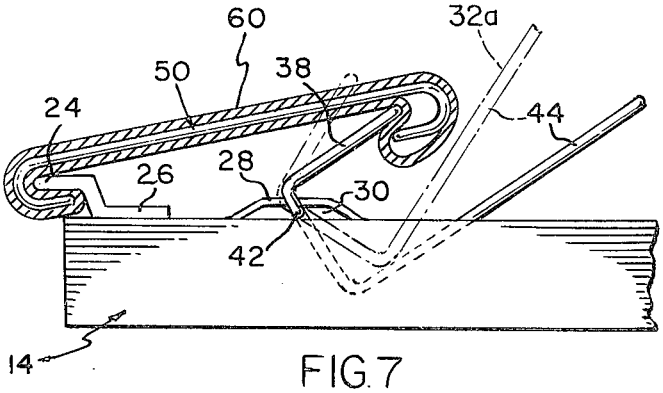
FIG. 7 is a side elevational view of an individual tread assembly with the clamping device in its open position, as during installation or removal of a tread member from the assembly.

At a location spaced rearwardly from tongue members 24, each support frame member 14 is formed with an upset portion 28 which, as best seen in the side elevational views of FIGS. 1 and 7 provides a horizontal slot 30 at the top of the frame member. The slots 30 are employed to receive and to support a clamp member designated generally 32 whose construction is best shown in the perspective view of FIG. 3.

Figure 3:
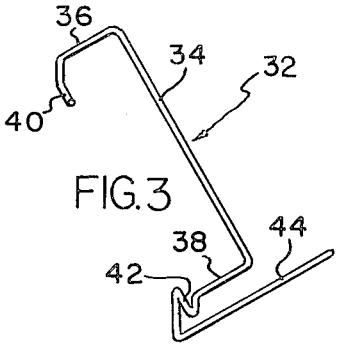
FIG. 3 is a perspective view of a clamp member employed in the assembly of FIG. 1.

Referring now to FIG. 3, clamp member 32 is formed from a single piece of rod stock and includes a tongue portion 34 which is integrally connected via crank portions 36 and 38 to pivot shaft portions 40 and 42 which are coaxially aligned with each other and which extend parallel to tongue portion 34. Pivot shaft section 42 is integrally connected to an arm 44 whose function will be discussed in greater detail below.

As seen in FIGS. 1 and 2, pivot shaft portions 40 and 42 pass through and are received in slots 30 in frame members 14 to support clamp member 32 upon the opposed frame members 14 for both pivotal movement and for a limited degree of horizontal movement back and forth along the tops of frame members 14. A tension spring 46 (FIGS. 1 and 4) is connected between pivot shaft portion 42 of the clamp member and the associated frame member 14 to resiliently bias clamp member 32 rearwardly or to the right as viewed in FIG. 1.

Tread members designated generally 50 are constructed from metal sheet material and include a flat main body portion 52 having downwardly and inwardly turned flange portions 54 extending along the opposed longitudinal edges of tread members 50 to define inwardly facing recesses 56 on the underside of tread member 50. As best seen in FIGS. 1 and 2, the tread members 50 are adapted to be supported upon and extend transversely between opposed pairs of tread support frame members 14.

Figure 6:
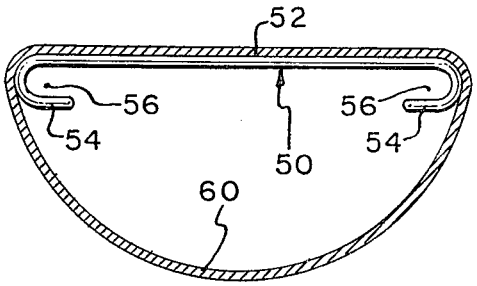
FIG. 6 is a side elevational view of a tread assembly with a carpeting sleeve in place.

In normal usage, tread members 50 are enclosed within an open ended tubular sleeve of carpeting 60, the sleeve 60 being of a length equal to that of tread members 50 and a circumference such that it is loosely received on the tread member as best seen in FIG. 6. The circumferential dimension of the sleeve is related to the dimensions of the tread members, including the re-entrant portions defined by recesses 56 such that when the sleeve is tucked into recesses 56 by the tongue members and clamp members as best seen in FIGS. 1 and 7, the sleeve is snugly conformed to all of the tread members surfaces, particularly the upper surface.

Referring now particularly to FIGS. 1 and 7 clamp member 32 is pivotally supported upon frame members 14 for pivotal movement between a release position indicated in broken line at 32*a* in FIG. 7 and a clamp position shown in FIG. 1. To install a convered tread member upon tread support frames 14, clamp member 32 is located in the broken line position shown in FIG. 7 and a tread member with a loosely engaged sleeve, such as in FIG. 6, is advanced onto the assembly by introducing tongue member 24 into one recess 56 in the tread member, the tongue member 24 pushing the covering 60 into the recess 56 ahead of it. The opposite longitudinal side of the tread member and carpet is rested upon clamp member 32, and the rearward or right-hand edge of the tread member is pushed downwardly, as by stepping on it, with the action illustrated in full line in FIG. 7 occurring as the tread member moves downwardly toward support frames 14, until the situation shown in FIG. 1 is achieved. Normally, the sleeve 60 will be made somewhat undersize (so that it cannot be fully seated in both recesses as shown in FIG. 1) and spring 46 permits clamp member 32 to longitudinally adjust itself to compensate for this, while at the same time snugly stretching the covering material 60 across the top of tread member 50.

To releasably latch clamp member 32 in its clamp position, a spring-type latch 64 (FIG. 4) may be employed to project through one side wall of frame member 14 into overlying relationship with arm portion 44. Spring 64 is fixedly secured to frame member 14 at its upper end as at 66 while the lower end of the spring is free so that it can be manually withdrawn to the right as viewed in FIG. 4 to permit release of arm 44.

In some installations, where it is desired to positively lock the tread members in place, a positive locking mechanism may be employed which includes a rigid rod 70 (FIGS. 1 and 5) pivotally secured to one set of frame members 14 as by passing through upset strap portions 72. At each frame member 14, a locking arm 74 is fixedly secured to rod 70 and projects through an opening 76 in the side wall of frame member 14 into overlying relationship with arm portion 44 of clamp member 32 when in its clamp position. A lock arm 78 fixedly secured to rod 70 may be secured to a securing eye 80 as by a padlock 82 (FIG. 1) to lock rod 70 against rotation from the position shown in FIG. 5. To release the clamp arms, it is necessary to unlock arm 78 and rotate rod 70 to swing the arms 74 clear of the arms 44 of the clamping members.

If desired, a vertically adjustable riser plate assembly 84 may be employed. Riser plate 84 includes a pair of vertical plates 86 and 88 which can be clamped into selected positions of vertical adjustment relative to one another as by bolts 90 which pass through a vertically elongate hole in one of two plates. A carpet clamping assembly designated generally 92 may be employed to hold a strip of carpeting in position upon the riser plate assembly, the plate assembly resting on one set of tread support frame members 14 and being frictionally held in position by the engagement between its upper edge and the covered tread assembly of the next higher tread.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

What is claimed is:

1. A stair tread construction comprising an elongate tread member having a flat main body portion and inturned flange portion extending along each of the opposed longitudinal edges of said main body portion in underlying relationship to said main body portion to define inwardly facing opposed longitudinal recesses on the underside of said tread member, a pair of tread support frame members extending transversely beneath said tread members adjacent the opposite ends thereof to support said tread member, an elongate tongue member fixedly mounted upon and extending between said support frame members and projecting into one of said recesses to anchor one longitudinal edge of said tread member to said support frame members, an elongate clamp member pivotally mounted on and extending between said support frame members, said clamp member having a longitudinal tongue portion projecting into the other of said recesses to anchor the other longitudinal edge of said tread member to said support frame members and to clamp said tread member against said tongue member, said clamp member being pivotally supported upon said support frame members for pivotal movement about an axis extending longitudinally of said tread member at a location intermediate the longitudinal edges of said main body portion, and a manually operable arm portion on said clamp member for pivoting said tongue portion of said clamp member between a generally horizontal tread member clamping position and an upwardly inclined tread member release position.

2. The invention defined in claim 1 further comprising a tubular sleeve of carpeting or other flexible floor covering material received upon and encompassing said tread member, said sleeve having a length substantially equal to that of said tread member and a circumferential extent such that said sleeve snugly encloses said tread member when portions of said sleeve are tucked into said recesses by said elongate members of said tongue means and said clamp means.

3. The invention defined in claim 2 wherein said clamp means comprises a pair of pivot shaft portions offset from and parallel to the elongate member of said clamp means, means on said frame members defining pivot shaft receiving slots extending longitudinally of the frame members supporting said clamp means for pivotal movement and for movement longitudinally of said frame members toward and away from said tongue means, and spring means biasing said clamp means away from said tongue means.

4. Apparatus as defined in claim 3 wherein said clamp means is movable between a clamp position and a tread member release position, and means for releasably latching said clamp means in said clamp position.

5. In a stair construction having a pair of spaced parallel tread support frame members fixedly supported in horizontally aligned relationship with each other;

a detachable tread assembly comprising an elongate tread member having a flat plate-like main body portion and integral downwardly and inwardly turned flange portions extending along the opposite longitudinal edges of said main body portion to define inwardly facing opposed longitudinal recesses on the underside of said tread member, an elongate first tongue fixedly mounted upon and extending between said frame members adjacent the outer end of said frame members, said tongue being offset upwardly from said frame members and adapted to project into one of said recesses of said tread member in overlying relationship to the flange portion of said tread member when the last-mentioned flange portion rests upon the frame members, an elongate second tongue parallel to said first tongue and extending between said frame members, pivot means supporting said second tongue upon said frame members for pivotal movement about an axis parallel to said first tongue between a release position wherein said second tongue is inclined upwardly from said pivot means and away from said first tongue and a clamp position wherein said second tongue extends generally horizontally from said pivot means away from said first tongue, said second tongue being receivable within the other of said recesses in said tread member to seat said first tongue in said one of said recesses as said second tongue is moved from said release to said clamp position.

6. The invention defined in claim 5 wherein said pivot means accommodates movement of the pivotal axis toward and away from said first tongue, and spring means coupled to said second tongue biasing said second tongue in a direction away from said first tongue.

7. The invention defined in claim 5 further comprising an arm on said second tongue, and retaining means on one of said frame members engageable with said arm to releasably retain said second tongue in said clamp position.

8. The invention defined in claim 7 wherein said retaining means comprises a spring latch.

9. The invention defined in claim 5 wherein said tread assembly further comprises an open and tubular sleeve of covering material having a length substantially equal to that of said tread member and a circumferential extent such that when said sleeve encompasses said tread member and is tucked into said recess by said tongue members the material of the sleeve is smoothly stretched across the upper surface of said tread member.

* * * * *